US012606275B2

(12) United States Patent
Walker et al.

(10) Patent No.: US 12,606,275 B2
(45) Date of Patent: Apr. 21, 2026

(54) VESSEL ATTITUDE CONTROL ARRANGEMENT

(71) Applicant: NAUTI-CRAFT LTD, Dunsborough (AU)

(72) Inventors: Laurence John Walker, Dunsborough (AU); Liam Peter Macfarlane-Barrow, Dunsborough (AU); Richard Monk, Dunsborough (AU)

(73) Assignee: NAUTI-CRAFT LTD, Dunsborough (AU)

( * ) Notice: Subject to any disclaimer, the term of this patent is extended or adjusted under 35 U.S.C. 154(b) by 617 days.

(21) Appl. No.: 17/996,845

(22) PCT Filed: Apr. 23, 2021

(86) PCT No.: PCT/AU2021/050372

§ 371 (c)(1),
(2) Date: Oct. 21, 2022

(87) PCT Pub. No.: WO2021/212185

PCT Pub. Date: Oct. 28, 2021

(65) Prior Publication Data

US 2023/0159136 A1 May 25, 2023

(30) Foreign Application Priority Data

Apr. 24, 2020 (AU) ..... 2020901290

(51) Int. Cl.

| | |
|---|---|
| ***B63B 1/14*** | (2006.01) |
| ***B63B 17/00*** | (2006.01) |
| ***B63B 39/00*** | (2006.01) |

(52) U.S. Cl.
CPC ..... *B63B 17/0081* (2013.01); *B63B 1/14* (2013.01); *B63B 39/005* (2013.01); *B63B 2001/145* (2013.01)

(58) Field of Classification Search
CPC ..... B63B 17/00; B63B 17/0081; B63B 39/00; B63B 39/005; B63B 1/00; B63B 1/22; B63B 1/14; B63B 2001/145
(Continued)

(56) References Cited

U.S. PATENT DOCUMENTS

| | | |
|---|---|---|
| 6,010,139 A | 1/2000 | Heyring et al. |
| 6,176,190 B1 | 1/2001 | Ozga |

(Continued)

FOREIGN PATENT DOCUMENTS

| | | |
|---|---|---|
| CN | 107128436 B | 9/2017 |
| CN | 207889950 | 9/2018 |

(Continued)

*Primary Examiner* — Lars A Olson
(74) *Attorney, Agent, or Firm* — Allen, Dyer, Doppelt + Gilchrist, PA

(57) ABSTRACT

A suspension system for a vessel (1) having at least one left hull (11), at least one right hull (12) and a chassis portion (10), the suspension system including supports (20) for at least partially supporting the chassis portion relative to the left and right hulls, and a front left and back left damping ram (31, 33) connected between the chassis portion and longitudinally spaced points on the at least one left hull, afront right and back right damping ram (32, 34) connected between the chassis portion and longitudinally spaced points on the at least one right hull. The suspension system further includes a deck attitude control system (250) comprising a controller (252), sensors, and a respective actuator arrangement for each of at least two orthogonally spaced damper rams. The actuators control a position of at least one point on the chassis relative to at least one reference.

23 Claims, 8 Drawing Sheets

(58) Field of Classification Search
USPC ..... 114/61.15
See application file for complete search history.

(56) References Cited

U.S. PATENT DOCUMENTS

| | | | | |
|---|---|---|---|---|
| 7,314,014 | B2 * | 1/2008 | Heyring | B63B 39/005 114/61.15 |
| 9,061,735 | B2 | 6/2015 | Heyring et al. | |
| 9,150,282 | B2 | 10/2015 | Heyring et al. | |
| 9,849,947 | B2 | 12/2017 | Longman | |
| 10,286,980 | B2 | 5/2019 | Monk et al. | |
| 10,315,736 | B2 | 6/2019 | Monk et al. | |
| 10,331,143 | B2 | 6/2019 | Monk et al. | |
| 2006/0144311 | A1 | 7/2006 | Heyring | |
| 2009/0227159 | A1 | 9/2009 | Meyer | |
| 2012/0024211 | A1 | 2/2012 | Wiltse | |
| 2013/0213288 | A1 | 8/2013 | Hall | |
| 2019/0092435 | A1 | 3/2019 | Longman | |

FOREIGN PATENT DOCUMENTS

| | | |
|---|---|---|
| FR | 2450192 | 9/1980 |
| JP | 61-75087 | 4/1986 |
| JP | 2017035975 | 2/2017 |
| WO | WO9836923 | 8/1998 |
| WO | 2004016497 | 2/2004 |
| WO | WO 2011/143694 | 11/2011 |
| WO | WO 2014/153600 | 10/2014 |
| WO | WO2015085352 | 6/2015 |
| WO | WO 2016/081990 | 6/2016 |
| WO | 2020082822 | 4/2020 |
| WO | WO 2020/113287 | 6/2020 |

* cited by examiner

VESSEL ATTITUDE CONTROL ARRANGEMENT

TECHNICAL FIELD

The present invention relates to vessels having a body or chassis and movable hulls and specifically relates to a suspension system between the body or chassis and at least two such movable hulls.

BACKGROUND

It is known to control the attitude of a body or chassis of a vessel relative the hulls which support it, at least in part. For example, in the Applicant's U.S. Pat. No. 9,061,735 there is a vessel having a body or chassis supported at least in part relative to a left hull and a right hull. When the vessel is a catamaran, so the body or chassis is completely above the surface of the water, then support is performed by a suspension system between the body or chassis and the left and right hulls. Conversely, when the body or chassis engages the water, such as including a central hull portion, said water-engaging central hull supports part of the mass of the body or chassis, with the remainder or partial support being provided by the suspension system between the body or chassis and the left and right hulls. In either case the pitch attitude and roll attitude of the body or chassis can be adjusted by controlling the suspension system.

The attitude of the body or chassis of the vessel can be controlled to minimise lateral, longitudinal, vertical and/or roll displacement between a point on the body or chassis and a reference point on an object. This can be particularly useful during transfer of personnel or goods between the vessel and the object. For example, in the Applicant's U.S. Pat. No. 9,849,947 the reference point can be a point on a pylon, dock or other vessel. The reference point can also be an absolute point in space.

As discussed in the Applicant's U.S. Pat. No. 10,286,980 the attitude of the body or chassis can be controlled to minimise lateral forces felt on the body or chassis of the vessel by adjusting the roll attitude of the body or chassis such that the line of action of the resultant of gravitational and centrifugal forces experienced by the body or chassis remains substantially perpendicular to the deck of the vessel.

It would therefore be desirable to provide a suspension system which enables adjustment or control of the pitch and roll attitude of the body or chassis of a vessel relative to at least two movable hulls using a mechanism that improves on the efficiency of at least some of the known arrangements or at least provides an alternative suspension system for a vessel.

SUMMARY OF INVENTION

According to a first aspect of the invention there is provided a suspension system for a vessel, the vessel having at least one left hull, at least one right hull and a chassis portion: the suspension system including locating arrangements for constraining motion of the left and right hulls in at least a longitudinal and a lateral direction relative to the chassis portion, supports for at least partially supporting the chassis portion relative to the at least one left hull and at least one right hull, and at least a front left and back left damper ram connected between the chassis portion and longitudinally spaced points on the at least one left hull, at least a front right and back right damper ram connected between the chassis portion and longitudinally spaced points on the at least one right hull; wherein the suspension system further includes a deck attitude control system comprising a controller, at least one respective front left, back left, front right and back right sensor selected from force, pressure, acceleration, orientation or position sensors, and a respective actuator arrangement for each of at least two longitudinally or laterally disposed damper rams of the front left, front right, back left and back right damper rams; the controller, in use, controlling the actuators in dependence on signals from the at least one force, pressure, acceleration, orientation or position sensor to control the attitude of the chassis portion, or to control a position of at least one point on the chassis relative to at least one reference. The controller may control the actuators to control the damping of the suspension system whenever the vessel is in use. Alternatively, the controller may control the actuators when the deck attitude control system is in operation, for example when the deck attitude is required to be controlled such as when stationary and the deck is required to remain substantially level, or for example when the vessel is docking with a pylon, dock, vessel or other object in which case a point on the deck may be controlled vertically relative to a point on the object.

Any of the supports and/or damper rams may be directly connected between the chassis portion and the associated hull, or indirectly connected therebetween, such as being connected between the chassis portion and the locating arrangements.

The at least one respective force, pressure, acceleration, orientation or position sensor may provide at least one respective output signal indicative of a force in the respective damper ram, or from which a force in the damper ram may be calculated. The at least one output signal may be a mount force or may be fluid pressures in a compression and a rebound chamber of the damper ram for example.

The at least one respective force, pressure, acceleration, orientation or position sensor may provide at least one respective output signal indicative of a displacement of the respective damper ram. Similarly, the at least one respective output signal may be indicative of an acceleration and/or velocity of the respective damper ram.

The at least one reference may be a point on an object, or an absolute point in space. For example, the at least one reference point on an object may be at least one point on a pylon, dock or another vessel or other object. Similarly, for example the orientation may be an absolute pitch orientation (i.e., relative to ground) and/or an absolute roll orientation (i.e., relative to ground).

Each damper ram may include an electro-mechanical ram. For example, each damper ram may be a linear electromagnetic actuator ram. Alternatively or additionally, each respective actuator arrangement may include a respective motor. The motor may be a motor-generator and/or the motor may be a linear motor or electro-magnetic actuator formed at least in part within and/or around the damper ram.

Each respective damping ram may include a fluid ram including a respective compression chamber and a respective rebound chamber, the actuator adjusting the pressures in the respective compression and/or rebound chamber of the at least two longitudinally or laterally disposed damper rams.

Each actuator arrangement for the respective one of the at least two longitudinally or laterally disposed damper rams may include at least one respective valve. For example, the at least one respective valve for a respective actuator may include: at least a respective variable valve such as for varying the damping force in the damper ram; and/or a proportional valve, such as for controlling the pressure in the at least a compression chamber of the respective damper ram; and or a lockout valve for isolating resilience or preventing damper flow during driven or motive operation of the damper ram.

At least two of the respective actuator arrangements may include a respective pump. The pump may be bi-directional and/or reversible.

The at least one respective valve may include: a respective damper compression chamber control valve in fluid communication with the respective damper compression chamber; a respective damper rebound chamber control valve in fluid communication with the respective damper rebound chamber.

The respective damper chamber control valve may adjust the pressure in the respective damper chamber.

The respective damper chamber control valve may selectively communicate the respective damper chamber with a pressure source. Additionally, the respective damper chamber control valve may selectively communicate the respective damper chamber with a fluid reservoir, such as for example, a tank. Alternatively, the damper ram may include a minimum pressure arrangement including non-return valves and a fluid pressure accumulator, the maximum pressure in the fluid accumulator being regulated by a pressure relief valve which relieves excess pressure to a reservoir or tank. Then, the respective damper chamber control valve may selectively communicate the respective damper chamber with the fluid accumulator.

The at least one respective valve may include a variable damper valve providing a controllable variable restriction between at least the compression chamber and the rebound chamber, or between the compression chamber and both the rebound chamber and an accumulator. The variable damper valve may be varied by the controller to provide a force in the damper ram that corresponds to a force required by the controller while pressures and flows in the damper ram and actuator arrangement are sufficient to provide the required force, after which the damper valve may be restricted or closed and the fluid pressure or volume in the compression and rebound chambers may be controlled using a pump and/or valves, a pressure source and a reservoir. The damper valve may include a controllable variable restriction valve and a passive valve in parallel, in which case, to completely close the damper valve the controllable variable restriction may be controlled to a closed position and a lockout valve may be provided in series with the passive valve (both in parallel to the controllable variable restriction valve) such that the lockout valve may be closed.

Each respective damping ram may be controlled by the controller to provide a damping force that corresponds to a force required by the controller up to an instantaneous limit damping force, beyond which power is supplied to the damping ram by the actuator arrangement to provide a motive force. The instantaneous limit damping force may be determined in part may a velocity or rate of displacement of the damper ram. When the actuator arrangement provides a motive force, the motive force may correspond to a force required by the controller. For example, when wave induced motion or motion due to inertia is moving the damper ram in the direction required by the controller to maintain the deck attitude or relative point location desired, and by the amount required, or can be made to do so for example by adjusting the variable damper setting, then the damper ram can act as a damper. Whether this is possible for any given point in time can be ascertained by a number of parameters including damper ram force, pressures in the damper ram chambers if the damper ram is a fluid ram, damper ram extension or contraction velocity, variable damper setting and/or damper ram extension or contraction acceleration. When this is not possible and external power is required to drive the position of the damper ram for the controller to maintain the deck attitude or relative point location desired, then the damper valve can be closed and a power or energy source can be used to drive the position of the damper ram.

The supports may vary in pressure (for example static, or non-dynamic pressure) by less than 25%, preferably less than 20%, more preferably less than 15% and most preferably less than 10%, through a range of at least 50%, preferably at least 60%, more preferably at least 70% and most preferably at least 80% of a travel of the support. The supports may vary in support force by less than 25%, preferably less than 20% more preferably less than 15% and most preferably less than 10%, through a range of at least 50%, preferably at least 60%, more preferably at least 70% and most preferably at least 80% of a travel of the support.

The supports may be independent. For example, the supports may provide a roll stiffness and/or a pitch stiffness in addition to a heave stiffness. For example, the supports may be independent mechanical, gas or oleo-pneumatic springs. Alternatively, the supports may be at least partially interconnected. For example the supports may provide less roll and/or pitch stiffness than heave stiffness. This can be achieved by for example interconnecting anchor points of torsion bars, interconnecting the gas volumes of gas springs or interconnecting the gas or oil volumes of at least two supports for at least two points of support between the hulls and the chassis portion.

The supports may be selectively interconnected. For example, the supports may be diagonally interconnected during deck attitude control system operations, to reduce or remove roll and/or pitch stiffness from the supports.

The supports may include a front left support ram, a front right support ram, a back left support ram and a back right support ram, each respective support ram having at least a respective support compression chamber, the respective support compression chamber forming at least part of a respective support compression volume.

The front left and front right support rams may be respectively interconnected by lateral cross connections, each respective lateral cross-connection being between the respective compression chamber of a front support ram on one side of the vessel and a support rebound chamber of a laterally spaced front support ram on an opposite side of the vessel; the back left and back right support rams may be respectively interconnected by lateral cross connections, each respective lateral cross-connection being between the respective compression chamber of a back support ram on one side of the vessel and a back rebound chamber of a laterally spaced back support ram on an opposite side of the vessel. For example, the front left, front right, back left and support rams are respectively interconnected by respective lateral cross connections: the front left support compression chamber of the front left support ram being connected to a front right support rebound chamber of the front right support ram by a front left compression conduit forming the front left support compression volume; the front right support compression chamber of the front right support ram being connected to a front left support rebound chamber of the front left support ram by a front right compression conduit forming the front right support compression volume; the back left support compression chamber of the back left support ram being connected to a back right support rebound chamber of the back right support ram by a back left compression conduit forming the back left support compression volume; and the back right support compression chamber of the back right support ram being connected to a back left support rebound chamber of the back left support ram by a back right compression conduit forming the back right support compression volume.

At least two of said front left, front right, back left or back right support compression volumes may be selectively interconnected. For example, the front left and back right support compression volumes may be selectively interconnected by a first diagonal support interconnection valve, and the front right and back left support compression volumes may be selectively interconnected by a second diagonal support interconnection valve. The first diagonal support interconnection valve may be in a first diagonal conduit and the second diagonal support interconnection valve may be in a second diagonal conduit, and a third support interconnection valve may be provided to selectively interconnect the first and second diagonal conduits. Any such selective interconnections may be open during a deck attitude control system operation and closed when the deck attitude control system is not in use. For example, said selective interconnections may be open during a deck attitude control system operation such as when the controller is controlling the actuators during transfer. Similarly, said selective interconnections may be closed when the deck attitude control system is not in use such as during transit.

It will be convenient to further describe the invention by reference to the accompanying drawings which illustrate preferred aspects of the invention. Other embodiments of the invention are possible and consequently particularity of the accompanying drawings is not to be understood as superseding the generality of the preceding description of the invention.

DESCRIPTION OF PREFERRED EMBODIMENT

Figure 1:
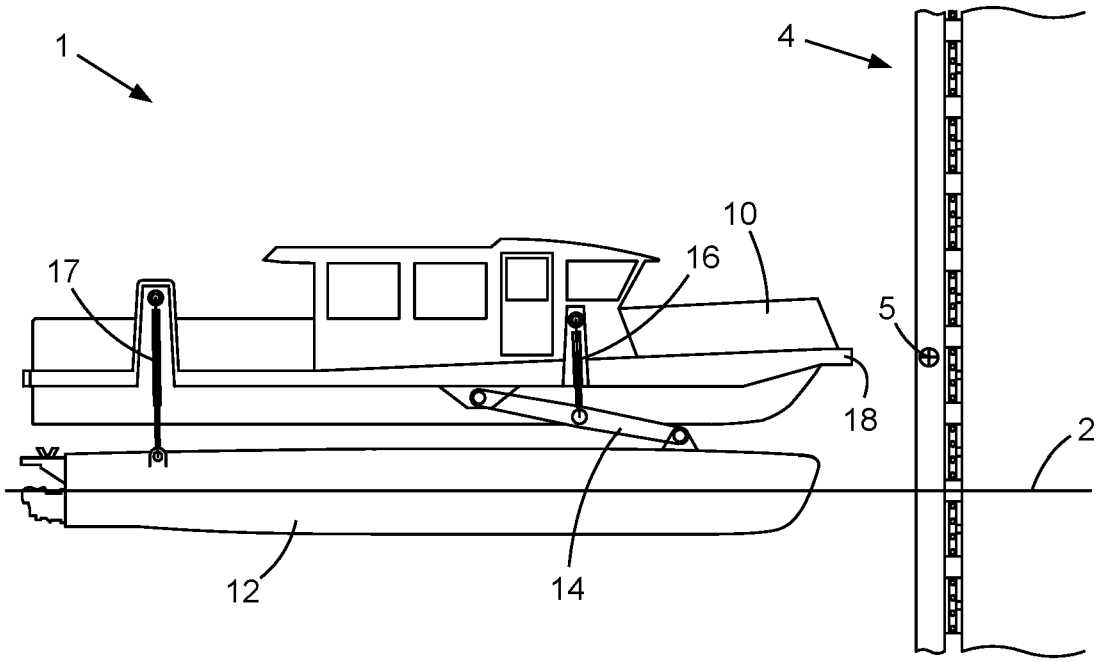
FIG. 1 is a side view of a vessel according to an embodiment of the present invention.

Referring initially to FIG. 1, there is shown a vessel 1 with a left hull (not shown) and a right hull 12 engaged in water 2. The present invention provides a deck attitude control system for controlling the attitude of the deck of the vessel 2 or for controlling the position of a point on the vessel relative to a point on an object or its absolute position or orientation in space. The vessel 2 is adjacent a pylon 4, so one possible use of the deck attitude control system is to minimise the relative vertical distance between a point on the vessel such as the bow 18 and a reference point 5 on the pylon 4.

The term chassis portion is intended to include the chassis or body of the vessel. The chassis portion 10 is located relative to the left hull and the right hull 12 by locating arrangements 14 such as the front leading arm shown in FIG. 1 although many other suitable locating arrangements are known and can be used instead. The chassis portion is supported relative to the left hull and right hull 12 by front suspension rams 16 and back suspension rams 17 located between the hulls and the chassis portion in any effective manner.

Figure 2:
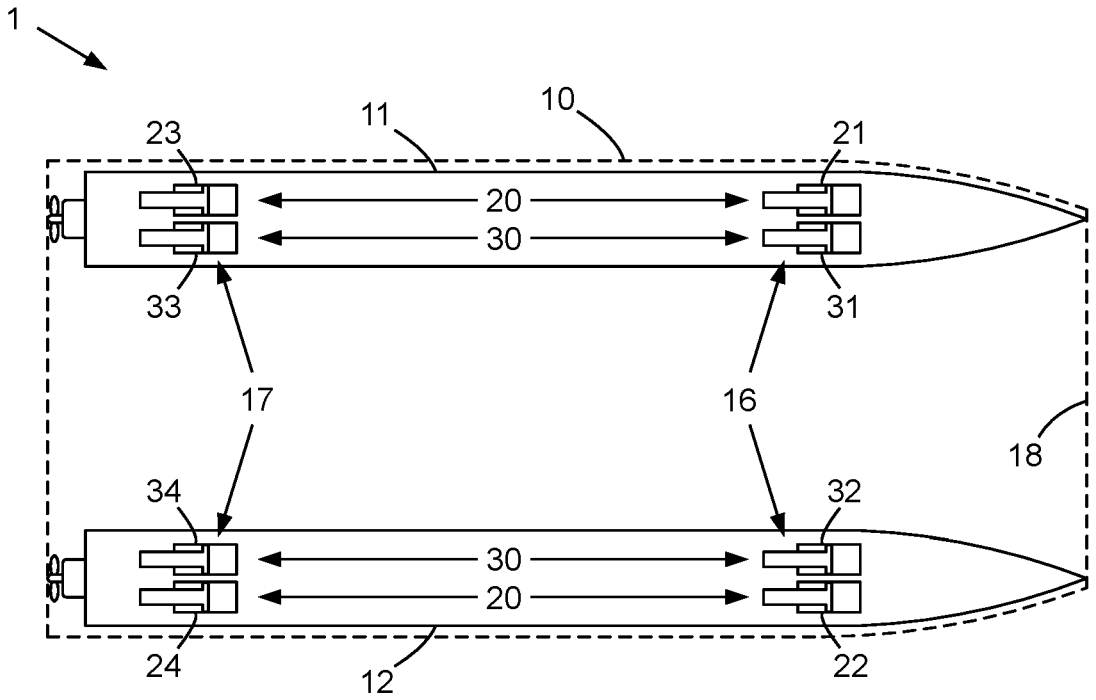
FIG. 2 is a schematic plan view of a vessel according to an embodiment of the present invention.

FIG. 2 shows the vessel in plan view with the chassis portion 10 in dashed lines which sits largely above the left hull 11 and the right hull 12, although the chassis portion could include a water engaging portion of a trimaran rather than the illustrated catamaran. The invention can also be applied to quadrimarans, i.e. vessels with four hulls such as a front left, front high, back left and back right hull.

The front and back suspension rams 16, 17 preferably each include supports 20 and damping arrangements 30, which together with a controller and actuator arrangements for the damper rams, form a deck attitude control system. So as shown in FIG. 2 the front suspension rams 16 include a front left support ram 21, a front left damper ram 31, a front right support ram 22 and a front right damper ram 32. Similarly, the back suspension rams 17 include a back left support ram 23, a back left damper ram 33, a back right support ram 24 and a back right damper ram 34.

If using the damper rams to control the attitude of the chassis portion, as in the present invention, it can be beneficial to use supports that provide less roll and/or pitch stiffness than conventional independent coil springs for example. This can be through using supports such as independent air springs with a low variation in stiffness through the centre of the stroke, or using additional gas volumes for fluid pressure accumulators of hydraulic rams. For example, the supports can vary in static, or non-dynamic pressure by less than 25%, preferably less than 20% more preferably less than 15% and most preferably less than 10%, through a range of at least 50%, preferably at least 60%, more preferably at least 70% and most preferably at least 80% of a travel of the support. Alternatively, when the damper rams of the deck attitude control system are being used to control the attitude of the chassis portion of the vessel, the supports 20 can be interconnected to reduce or substantially remove their roll and/or pitch stiffness.

Figure 3:
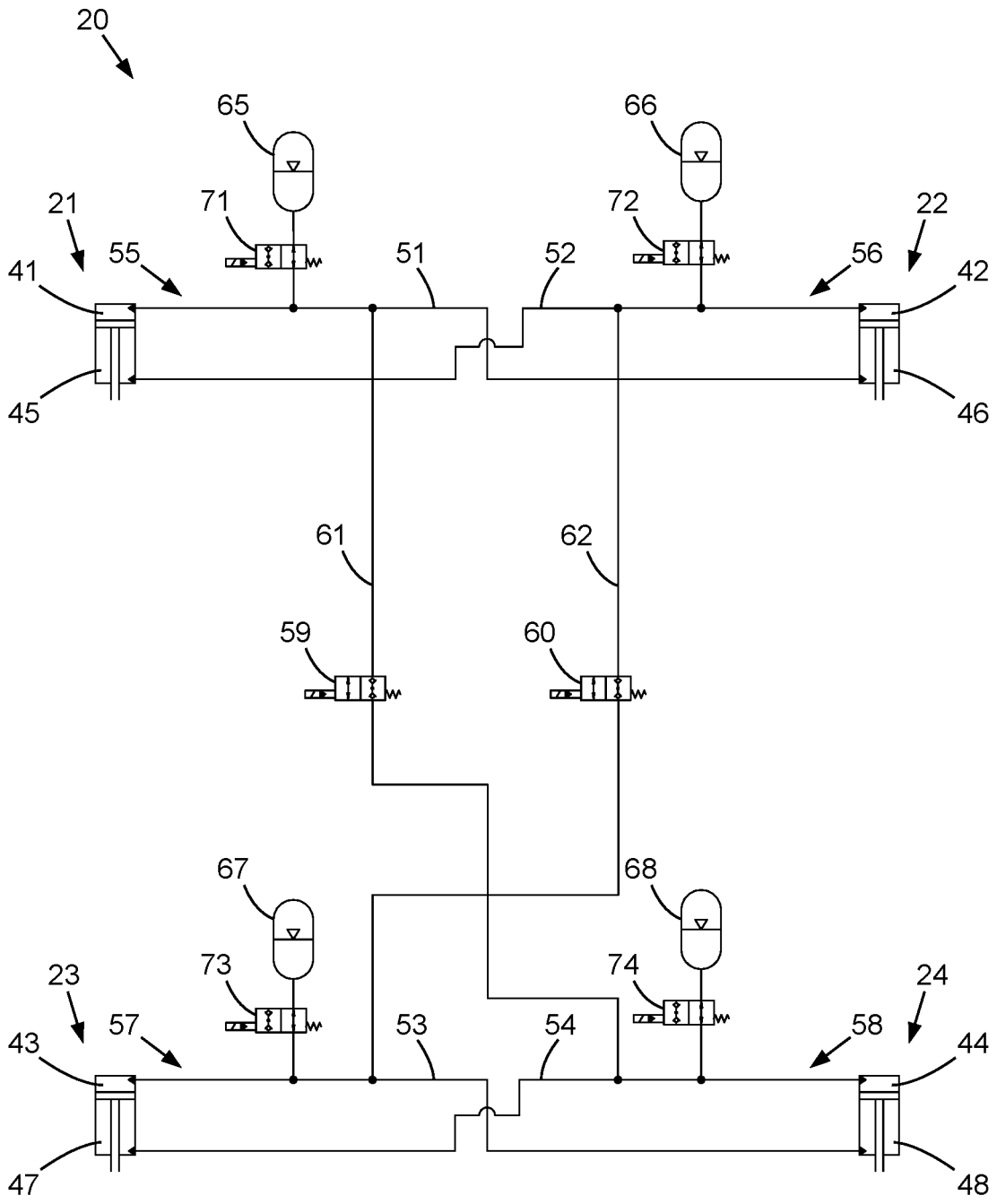
FIG. 3 is a schematic view of a possible support arrangement of a suspension according to an embodiment of the present invention.

FIG. 3 shows an arrangement of the supports 20 in which each support ram 21, 22, 23, 24 includes a respective compression chamber 41, 42, 43, 44 and a respective rebound chamber 45, 46, 47, 48. The front left support compression chamber 41 is in fluid communication with the front right support rebound chamber 46 through the front left lateral cross-connection 51 forming a front left support compression volume 55. Similarly, the front right support compression chamber 42 is in fluid communication with the front left support rebound chamber 45 through the front right lateral cross-connection 52 forming a front right support compression volume 56. The back left support compression chamber 43 is in fluid communication with the back right support rebound chamber 48 through the back left lateral cross-connection 53 forming a back left support compression volume 57 and the back right support compression chamber 44 is in fluid communication with the back left support rebound chamber 47 through the back right lateral cross-connection 54 forming a back right support compression volume 58. The front left, front right, back left or back right support accumulator 65, 66, 67, 68 is connected to the respective support compression volume 55, 56, 57, 58 via a respective support accumulator valve 71, 72, 73, 74. The support accumulator valves are preferably lockout valves, but can be or include any form of damper valve or variable restriction.

Such a laterally cross-connected arrangement of double-acting rams front and back will inherently provide a higher roll stiffness than the pitch and heave stiffness. However, by providing a first diagonal support interconnection valve 59 in a first diagonal conduit 61 between the front left and back right support compression volumes 55, 58 and providing a second diagonal support interconnection valve 60 in a second diagonal conduit 62 between the front right and back left support compression volumes 56, 57, the roll and pitch stiffness of the supports can be reduced or removed, whilst maintaining the heave stiffness. While the suspension system of the vessel is in passive operation, the diagonal support interconnection valves are normally closed, so the supports provide a common heave and pitch stiffness with a higher roll stiffness. However, when the deck attitude control system is in operation, i.e., when the attitude of the chassis portion is being controlled through the damper rams, the first and second diagonal support interconnection valves 59, 60 can be opened (and are preferably opened) to allow flow along the first diagonal conduit 61 between the front left and back right support compression volumes and to allow flow along the second diagonal conduit 62 between the front right and back left support compression volumes. Flow through these two diagonal conduits 61, 62 interconnecting diagonally opposite support compression volumes will reduce or remove the roll and pitch stiffness provided by the supports 20.

Figure 4:
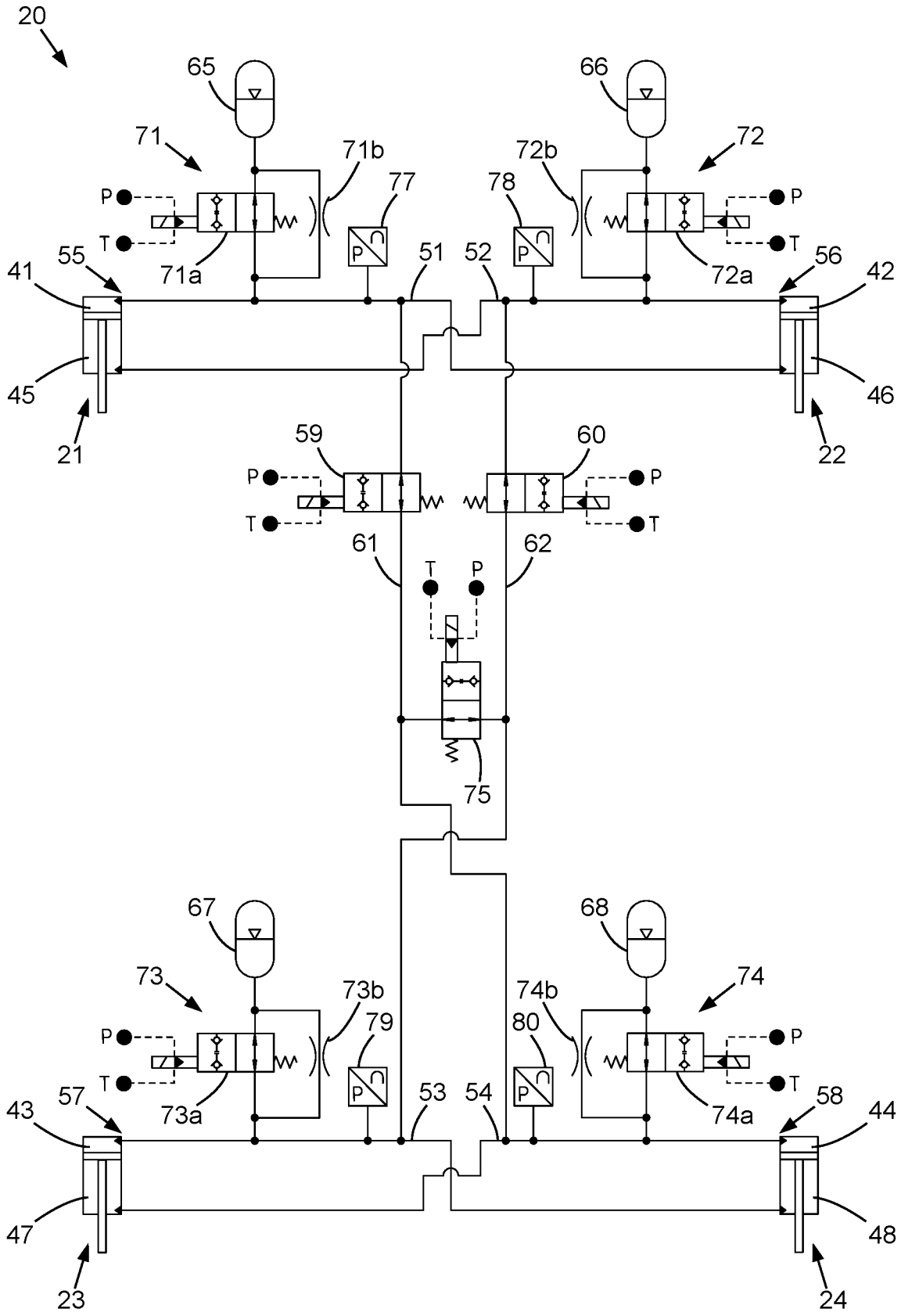
FIG. 4 is a schematic view of a further possible support arrangement of a suspension according to an embodiment of the present invention.

FIG. 4 shows the addition of a third support interconnection valve 75 which selectively connects between the first diagonal conduit 61 and the second diagonal conduit 62. So, while when open, the first and second diagonal support interconnection valves 59, 60 reduce or remove the roll and pitch stiffness provided by the supports 20, opening the third support interconnection valve 75 in addition will remove the warp stiffness of the supports 20. So for example, if a wave passes diagonally under the vessel, compressing for example the front left support ram 21 and back right support ram 24 at the same time, then fluid from the front left and back right support compression volumes 55, 58 can flow through the third support interconnection valve and into the front right and back left support compression volumes 56, 57. This allows the average height of the two diagonals (the front left and back right rams versus the front right and back left rams) to freely vary relative to the each other whilst maintaining support of the overall average height of the chassis of the vessel.

As noted in relation to FIG. 3, the respective support accumulator valves 71, 72, 73, 74 are preferably lockout valves, but can be or include any form of damper valve or variable restriction. In FIG. 4 each of the respective front left, front right, back left and back right support accumulator valves 71, 72, 73, 74 comprises a respective support accumulator lockout valve 71*a*, 72*a*, 73*a*, 74*a* in parallel with a respective support accumulator bypass bleed 71*b*, 72*b*, 73*b*, 74*b* which is an orifice or other restriction to allow pressure difference between the respective accumulator and the respective support compression volume to gradually reduce. The purpose of this is to provide a passive means of reducing said pressure difference over time to allow the parallel lockout valve to be opened without suddenly changing the volume of fluid in the respective support compression volume as such sudden changes can generate undesirable accelerations of the chassis portion. The restriction provided is such that the accumulators do not provide a significant amount of resilience in a short time period as considered by the controller, although the buoyant interface of the hulls with the water remains.

The lockout valves 59, 69, 75, 71*a*, 72*a*, 73*a*, 74*a* in FIG. 4 are shown as solenoid pilot operated normally open valves with the solenoid operating the connection to pump pressure P or tank T to energise and close or de-energise and open the respective valve. Front left, front right, back left and back right support compression volume pressure sensors or transducers 77, 78, 79, 80 are also shown in FIG. 4 as the deck attitude control system controller can benefit from access to the support pressures.

FIG. 4 shows the damping arrangements 30. Each respective damper ram 31, 32, 33, 34 includes a respective damper compression chamber 83, 84, 85, 86 and a respective damper rebound chamber 87, 88, 89, 90. Each respective damper ram can be controlled by a respective actuator arrangement 101, 102, 103, 104. A respective damper compression chamber pressure sensor 105, 106, 107, 108 is provided to give an indication of the pressure in the respective compression chamber and similarly a respective damper rebound chamber pressure sensor 109, 110, 111, 112 is provided to give an indication of the pressure in the respective rebound chamber. This allows the damper ram force to be calculated. Respective ram displacement, velocity and/or acceleration sensors can be provided but are not shown in FIG. 4.

In each of the front left, front right, back left and back right actuator arrangements, a respective variable damper valve 121, 122, 123, 124 is located within an H-bridge type arrangement of non-return valves 163. This arrangement allows a single variable damper valve to be used to control the damping flows in both the compression and rebound directions and permits the respective damper accumulator 145, 146, 147, 148 to absorb and replenish fluid volume as required with displacement of the damper ram rod in and out of the cylinder of the damper ram. Also provided within the centre of the H-bridge type arrangement, in parallel with the respective damper valve 121, 122, 123, 124, is a respective orifice 125, 126, 127, 128 which is optional but can improve smoothness through the zero flow position. To prevent unwanted flow through the respective orifice 125, 126, 127, 128 when the respective variable damper valve is closed, a respective orifice lockout valve 129, 130, 131, 132 can optionally be provided in series with the respective orifice 125, 126, 127, 128. Also in parallel with the respective variable damper valve 121, 122, 123, 124 and the respective orifice 125, 126, 127, 128 is a respective damper pressure relief valve 141, 142, 143, 144 to prevent excessively high pressures in the respective damper compression and rebound chambers.

When the damper arrangement is controlled to drive the attitude of the chassis portion, only two orthogonally spaced damper rams need to be driven to control the roll and pitch attitude of the chassis portion. For example the two left damper rams 31 and 33 could be driven, or the two right damper rams 32, 34 or the two back damper rams 33, 34. However in the example shown in FIG. 4, the two front damper rams 31, 32 are driven, so the front left and the front right damper compression chamber control valves 133, 134 are provided to selectively communicate the respective damper compression chamber 83, 84 with a pressure source 161 or a reservoir or tank 162. Similarly a front left and a front right damper rebound chamber control valve 137, 138 is provided to selectively communicate the respective damper rebound chamber 87, 88 with a pressure source 161 or a reservoir or tank 162. As the two orthogonally spaced damper rams 31, 32 are driven by the respective actuator arrangements 101, 102, the other two damper rams 33, 34 can be controlled by the respective actuator arrangements 103, 104 to allow the chassis portion to pivot on the low or zero roll and pitch stiffness supports, as described in FIG. 3 for example.

The pressure within the front left, front right, back left and back right damper accumulators 145, 146, 147, 148 is typically low, such as a static pressure of 12 bar for example, as the accumulators are used to compensate for the variation in net cylinder fluid volume at different positions throughout the cylinders stroke during normal damper operation as explained above. However, over time, for example, with temperature changes and the repeated operation of the front left and front right damper compression chamber control valves 133, 134 and the respective damper rebound chamber control valves 137, 138, the front left, front right, back left and back right damper accumulators 145, 146, 147, 148 can gradually empty or fill. So in FIG. 4, a respective damper accumulator control valve 149, 150 is provided between the respective damper accumulator 145, 146 and the fluid pressure source 161 to allow the volume of fluid in the respective accumulator to be maintained and prevent the accumulator from running out of fluid or bottoming out. Similarly a respective damper accumulator pressure relief valve 153, 154 is provided between the respective damper accumulator and the reservoir or tank 162 to prevent the respective accumulator from increasing in pressure to pressures above a desirable range.

The pressure in the respective front left, front right, back left and back right damper accumulators 145, 146, 147, 148 can be measured using respective damper accumulator pressure sensors 157, 158, 159, 160 which can be beneficial both for control of the front left and front right damper accumulator control valves 149, 150 and for other calculations by the controller such as calculating the pressure differential over the respective variable damper valve 121, 122, 123, 124 to determine if the pressure differential is sufficient and if so, how to adjust the restriction of the respective variable damper valve to continue to allow the required flow. If the pressure differential is insufficient to enable the required damper force to be generated, the respective variable damper valve can be closed (along with the respective orifice lockout valve 129, 130 if present) and the respective damper compression chamber control valve 133, 134 or the respective damper rebound chamber control valve 137, 138 operated to control the pressures in the respective chambers and generate the required damper force and/or displacement, velocity or acceleration.

Figure 5:
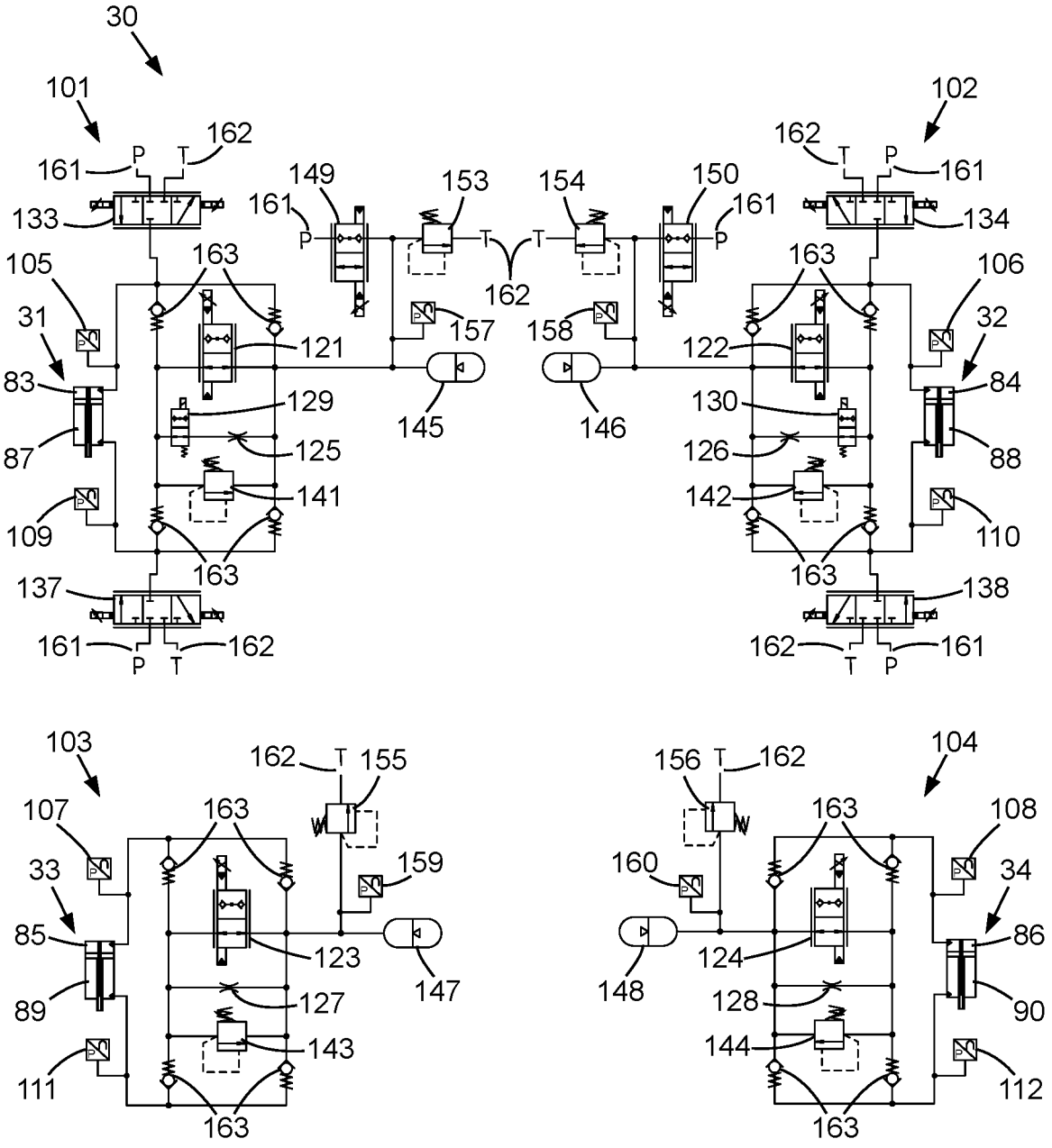
FIG. 5 is a schematic view of a damper arrangement according to an embodiment of the present invention.

FIG. 5 shows an alternative damping arrangement 30, being a modification of the damping arrangement shown in FIG. 4. In FIG. 5 the low pressure side of the front left and front right damper compression and rebound chamber control valves 133, 134, 137, 138 is connected to the respective front left or front right damper accumulator 145, 146. This can significantly reduce or prevent the respective damper accumulator from running out of fluid or bottoming out during operation of the respective actuator arrangement 101, 102. Therefore the respective damper accumulator control valves 149, 150 of FIG. 4, which are typically high flow valves with fast response, are no longer required and can be omitted. The remainder of the damping arrangement 30 of FIG. 5 is the same as that of FIG. 4 and the other components of the arrangement can operate in the manner discussed above in relation to FIG. 4.

Figure 6:
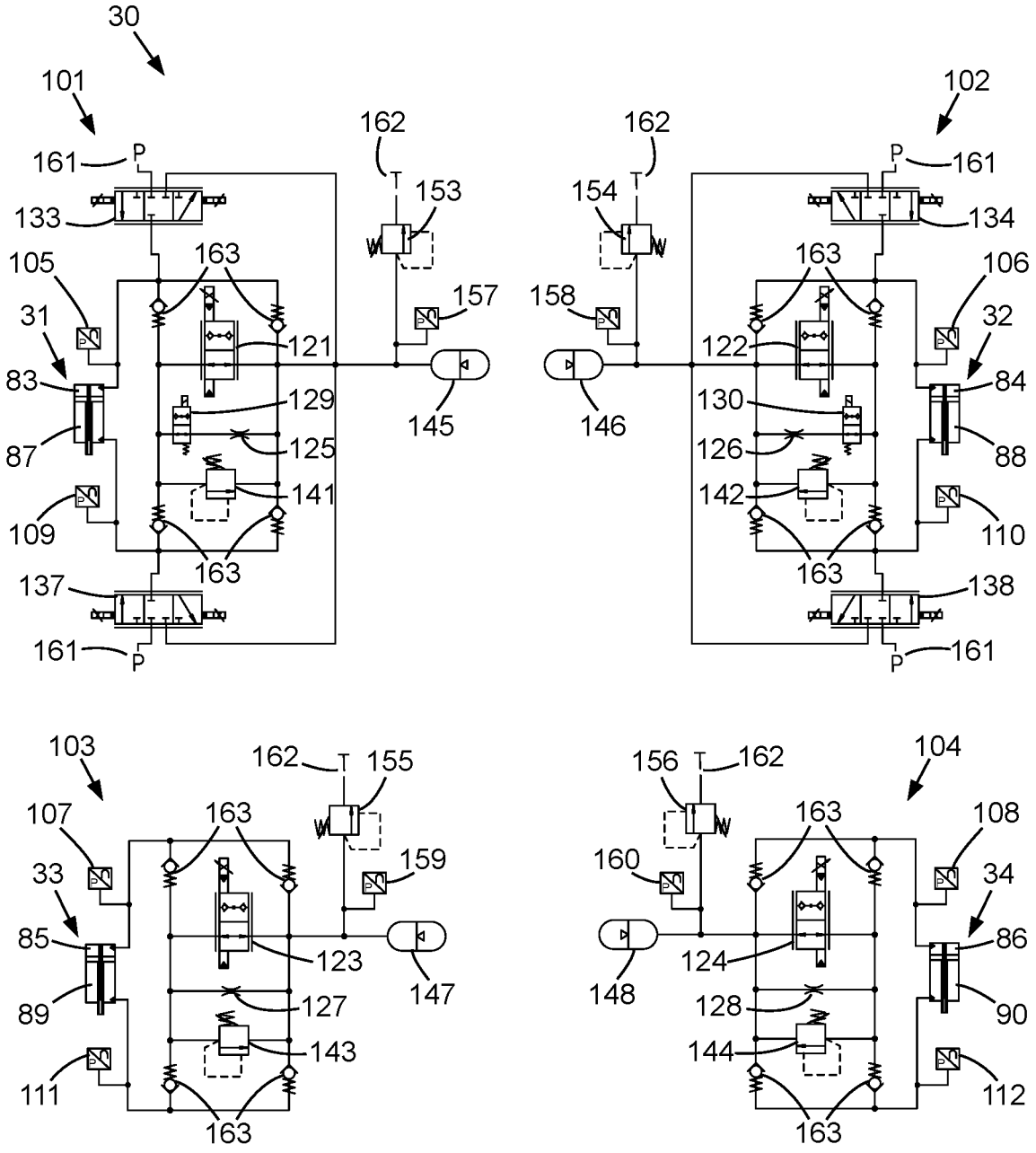
FIG. 6 is a schematic view of an alternative damper arrangement according to an embodiment of the present invention.

FIG. 6 shows a further alternative damping arrangement 30 in which a single axial piston pump for example can be used in place of a respective pair of damper compression and rebound control valves (such as 133 and 137; or such as 134 and 138 in FIGS. 4 and 5). In each of the two orthogonally spaced damper rams 31, 32 driven by the respective actuator arrangements 101, 102, a respective front left or front right damper variable displacement bi-directional pump 181, 182 is used between the respective damper compression chamber 83, 84 and the respective damper rebound chamber 87, 88. Ideally the respective damper valve 121, 122 and any respective orifice lockout valve 129, 130 (where present) is closed during operation of the respective variable displacement bi-directional pump 181, 182. The variable displacement bi-directional pump 181, 182 may be a single direction pump used in a switched H-bridge type arrangement as is known to allow single-direction pumps to perform the task of a bi-directional pump. Similarly the pump may be variable speed rather than variable displacement to achieve a similar outcome.

When the front left or front right damper pump 181, 182 is being driven to extend the respective damper ram 31, 32, fluid from the respective damper rebound chamber 87, 88, plus additional volume-compensation fluid from the respective damper accumulator 145, 146 which is supplied through one of the non-return valves 163, is drawn through the respective pump 181 or 182 and into the respective damper compression chamber 83, 84. Conversely, when the front left or front right damper pump 181, 182 is being driven to compress the respective damper ram 31, 32, a respective pilot conduit 185, 186 is provided to allow pressure from the respective damper rebound chamber 87, 88 to unseat one of the non-return valves 163 to allow excess fluid flowing from the respective damper compression chamber 83, 84 to flow into the respective damper accumulator 145, 146, with the remainder flowing through the respective pump 181 or 182 and into the respective damper rebound chamber 87, 88.

Figure 7:
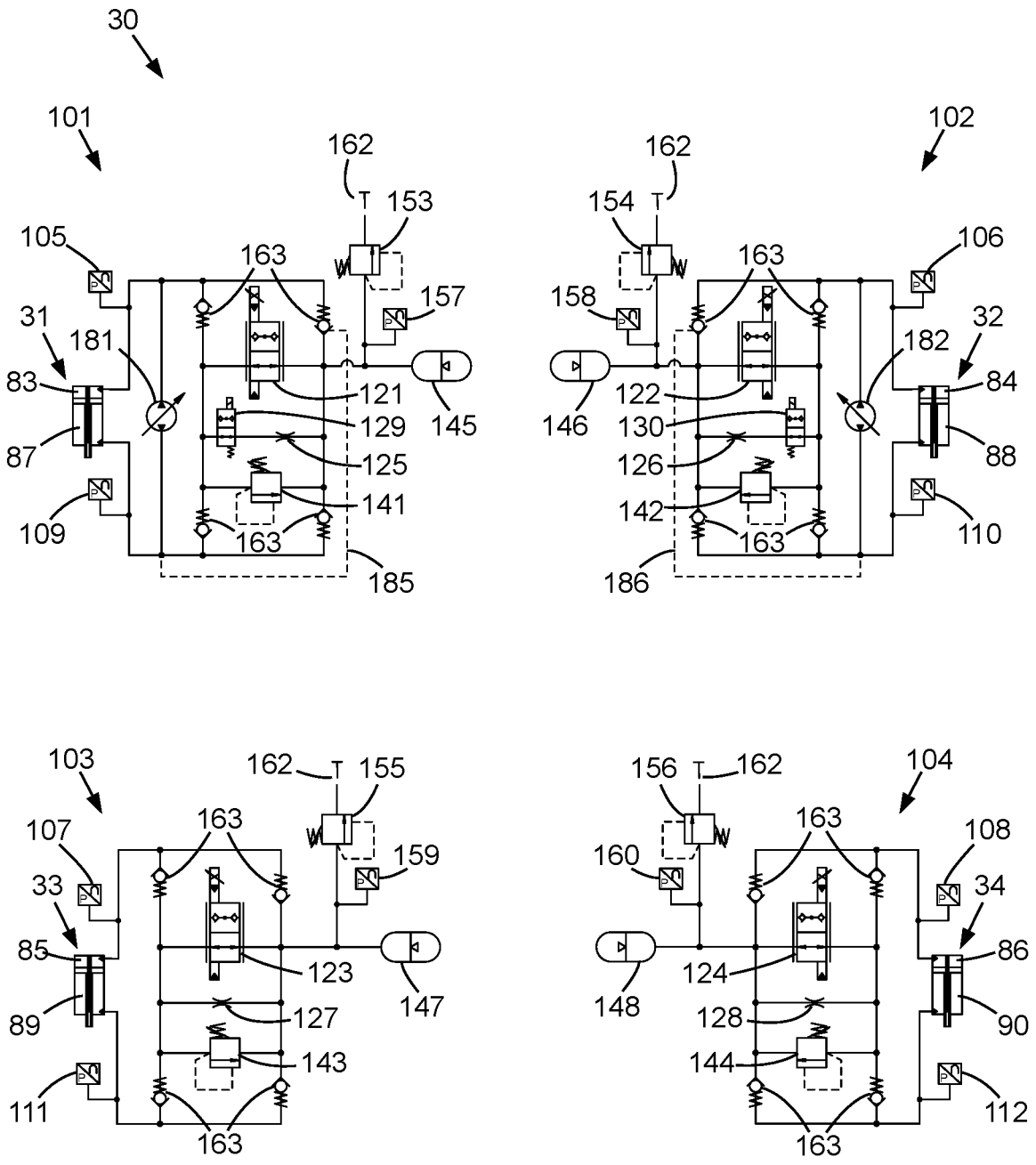
FIG. 7 is a schematic view of an alternative damper arrangement according to an embodiment of the present invention.

While all four damper rams can be driven using the pressure source as in FIGS. 4 and 5 or a respective pump as in FIG. 6, the use of a support arrangement providing heave support with low or substantially no roll and pitch stiffness as shown in FIGS. 3 and 4 can permit the use of only two driven damper rams, simplifying both control and two of the damper actuator arrangements. However, if only two damper rams are driven, it is preferable that the two driven damper rams are located at the end of the vessel with the largest load or greatest mass. For example, in a case where the vessel has a load deck at the rear which can take a large payload, if the driven damper rams are at the front, for the deck attitude control system to provide an extending force at the back able to lift the large payload, the supports need to provide heave support with little support in pitch and roll and the front driven dampers such as in FIGS. 5 to 7 need to generate a high pressure in the rebound volumes to contract the front and drive the chassis to pitch giving the rise in height at the back. In such vessels where the largest load applied to the suspension system is at the back, then the driven damper rams should be the back damper rams as shown in FIG. 8.

A maintenance control arrangement may be provided to maintain the pressure and fluid volumes in the various damper compression and rebound chambers and the damper accumulators, especially in damping arrangements where there are no control valves to control supply of fluid from a pressure source or to a tank for each damper ram, i.e. as in the examples in FIGS. 4, 5 and 6. FIG. 8 shows in and out valves for the volume in each damper.

Figure 8:
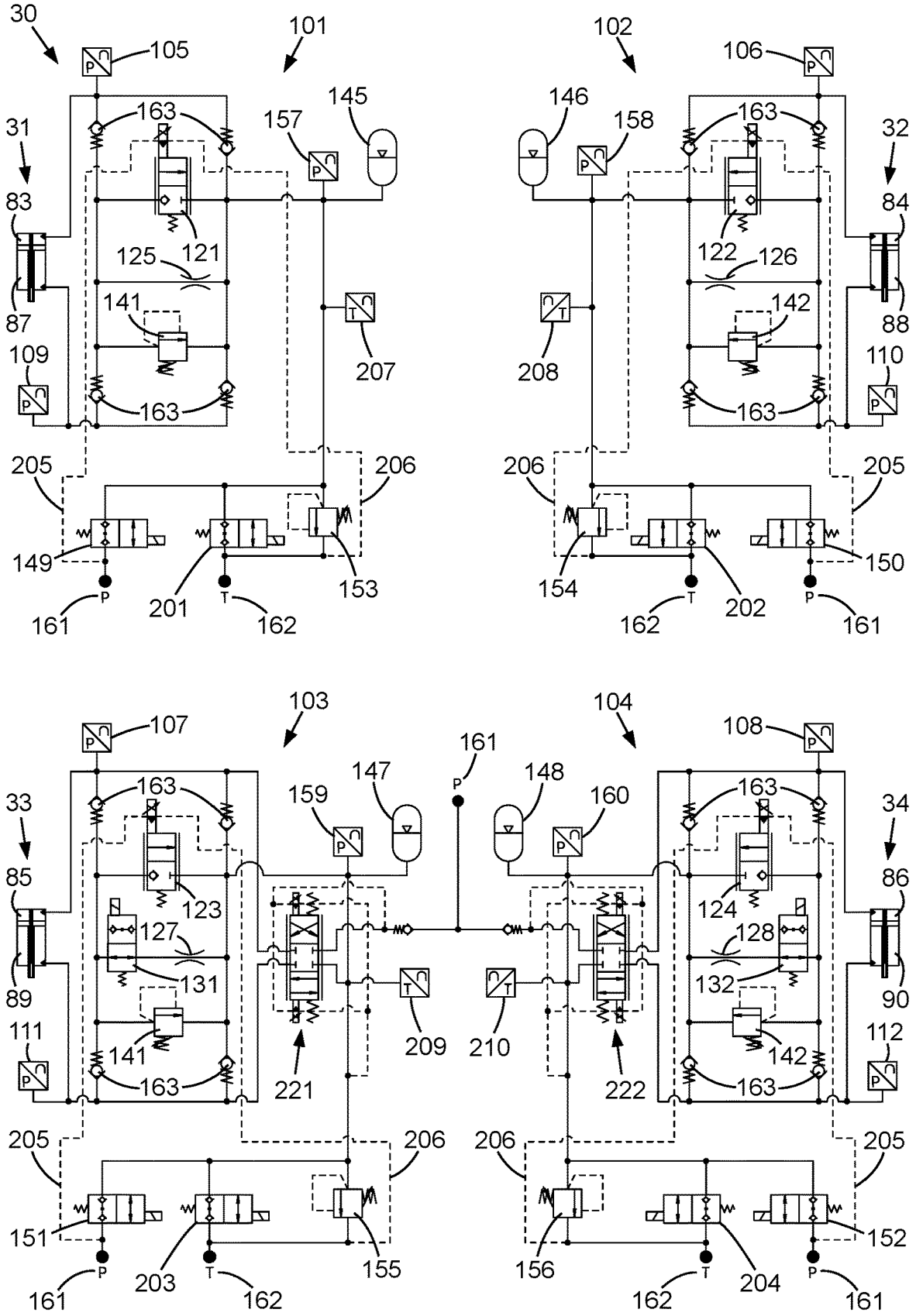
FIG. 8 is a schematic view of a further alternative damper arrangement according to an embodiment of the present invention.

Referring to FIG. 8, there is shown a further alternative damping arrangement 30. While the principles are the same as in damping arrangements of FIGS. 5 to 7, there are many variations in the embodiment shown in FIG. 8 such as the back left and back right actuator arrangements 103, 104 being the driven dampers rather than the front actuator arrangements 101, 102, as discussed above. In addition to the respective front left, front right, back left or back right damper accumulator control valve 149, 150, 151, 152 and connected to a fluid pressure source 161 and a respective damper accumulator pressure relief valve 153, 154, 155, 156 connected to tank or reservoir 162, for maintaining the pressure in the respective damper accumulator 145, 146, 147, 148, there is also provided a respective damper accumulator out valve 201, 202, 203, 204.

Pilot pressure conduit 205 and a pilot tank conduit 206 are shown for each variable damper valve 121, 122, 123, 124 as these valves can be solenoid pilot operated valves. Respective damper accumulator fluid temperature sensors 207, 208, 209, 210 are also shown. As the viscosity of fluid can change with temperature, it can be beneficial to know the temperature of the fluid in the respective damper accumulator or elsewhere in the respective actuator arrangement. Cooling can be provided and can be controlled to assist heat exchange in dependence on the measured temperatures.

The operation of the driven back left and back right actuator arrangements 103, 104 is very similar to that described for the driven front left and front right actuator arrangements of FIG. 5 for example. Back left and back right orifice lockout valves 131, 132 are optionally provided in series with the respective orifice 127, 128 to prevent unwanted flow through the respective orifice when the respective variable damper valve 123, 124 is closed.

The individual front left or front right damper compression chamber control valves 133, 134 and rebound chamber control valves 137, 138 of the driven front actuator arrangements 101 103 of FIG. 5 are replaced with a single back left or back right directional control valve 221, 222 in FIG. 8. Each respective back left or back right directional control valve selectively communicates a source of pressurised fluid 161 with either the compression or rebound chamber of the respective back damper ram while the other of the compression or rebound chamber with the respective damper accumulator 147 148 and the respective damper accumulator pressure relief valve.

While the directional control valves 221, 222 essentially control the driving of the back actuator arrangements 103, 104, the damper accumulator pressure relief valves 155, 156, damper accumulator out valves 201, 202 and damper accumulator control valves 151, 152 maintain the pressure in the driven back left and back right actuator arrangements within a desired range.

Figure 9:
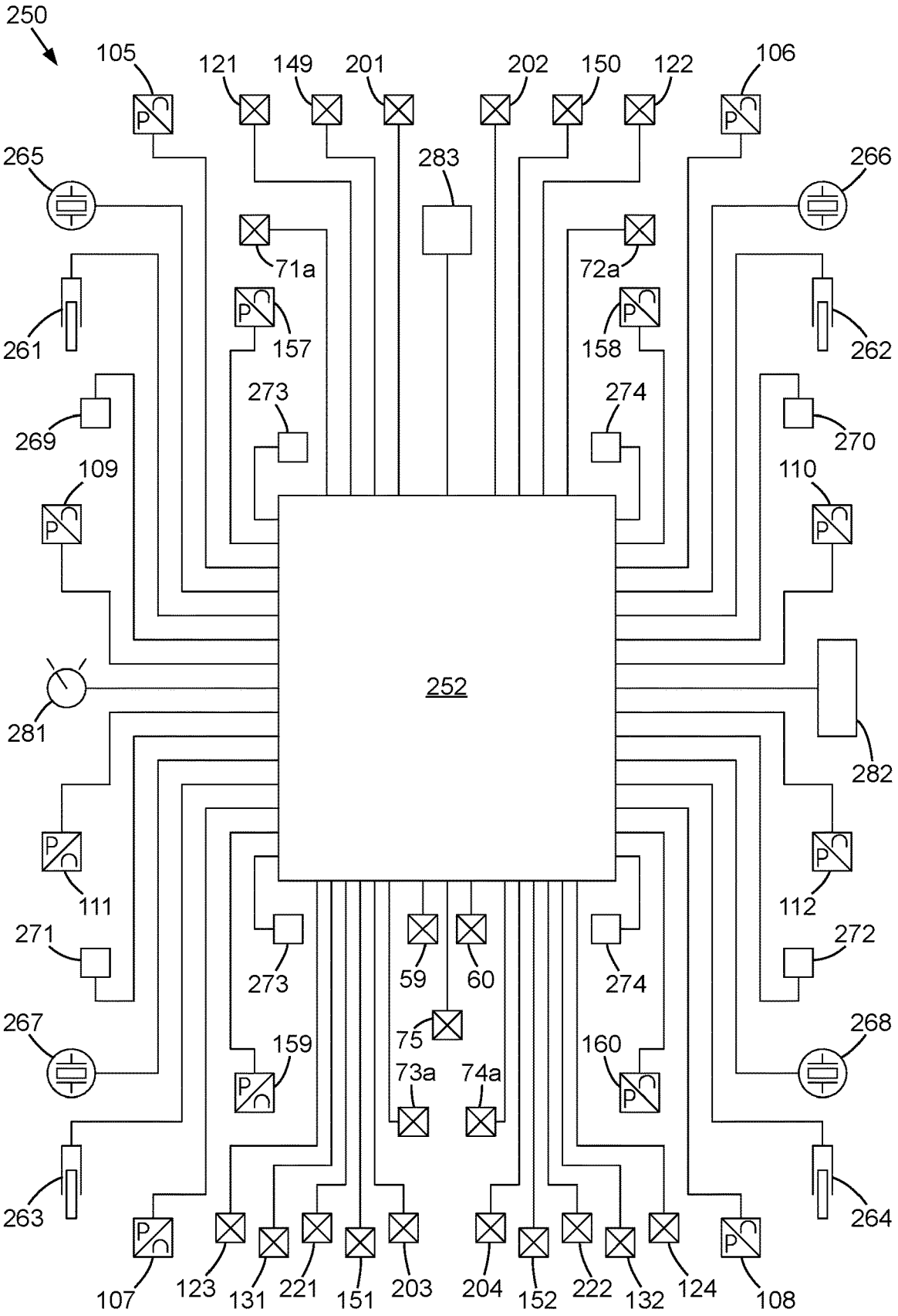
FIG. 9 is a schematic view of control components of a deck attitude control system according to an embodiment of the present invention.

In FIG. 9 the control components of the deck attitude control system 250 are shown, i.e., the controller 252, sensors and valves. The rams and conduits of FIG. 8 are omitted in FIG. 9 for clarity, but like valves are given like reference numerals. For each respective front left, front right, back left and back right support or damper ram (not shown) a respective displacement sensor 261, 262, 263, 264 is shown in communication with the controller 252. A respective support or damper ram force sensor 265, 266, 267, 268 can be provided to enable the force in the support ram or damper ram to be measured, or alternatively, additional pressure sensors on or near the compression and rebound chambers of the respective ram can be used to calculate the force in the respective ram. For example, the respective damper compression chamber pressure sensors 105, 106, 107, 108 and the respective damper rebound chamber pressure sensors 109, 110, 111, 112 are typically required for damping control so can be used to calculate the respective damper ram force.

The respective damper accumulator pressure sensors 157, 158, 159 160 are also in communication with the controller to enable the accumulator pressure to be maintained. Although this function could be performed by a separate controller, it is preferable to include it in the main deck attitude system controller 252. A respective front left, front right, back left and back right hull accelerometer 269, 270, 271, 272 can be mounted on or near the respective support or actuator arrangement on the hull portion of the ram or on the hull itself to provide signals to the controller indicative of acceleration in or about one or more axis.

One or more accelerometers can be provided on the chassis portion of the vessel. In this example shown in FIG. 9, chassis accelerometers 273, 274, 275, 276 are mounted on the chassis near each support and/or damper ram, but any number of accelerometers can be used in any location. For example, one multi-axis accelerometer may be used in any position on the chassis to measure the linear and rotational accelerations on the chassis portion in place of or in addition to a number of accelerometers placed at locations dispersed around the chassis portion. For example, the controller may include a multi-axis accelerometer or gyroscope sensor integrated into the board or case of the controller.

A mode switch 281 or other input means such as a selection on a touch screen or a voice control can be used to change the mode of the controller. The controller 252 is connected to the support accumulator lockout valves 71*a*, 72*a*, 73*a*, 74*a* and the first and second diagonal support interconnection valves 59, 60 and the third support interconnection valve 75 to control the resilience and the stiffness modes of the supports, primarily in dependence on the mode of the controller. For example, if the active deck attitude control or transfer mode is selected and at least two of the damper rams are being driven to adjust the pitch and roll attitude of the chassis portion, then the support accumulator lockout valves 71*a*, 72*a*, 73*a*, 74*a* can be closed to remove their resilience from the supports and the support interconnection valves 59, 60, 75 can be opened to remove the pitch, roll and warp stiffness of the supports.

The controller 252 is also connected to the respective variable damper valve 121, 122, 123, 124, the back left and back right orifice lockout valves 131, 132, the respective front left, front right, back left or back right damper accumulator control valve 149, 150, 151, 152, the respective damper out valve 201, 202, 203, 204 and the back left and back right directional control valves 221, 222. The controller is connected to the above valves in order to control them in response to the inputs from the sensors and the mode switch. Status and/or warnings and other information can be displayed on a display 282 which can be specific to the deck attitude control system or part of a user interface used by other systems on the vessel.

For example, when the mode switch 281 is in a normal or transit mode, the deck attitude control system 250 can be inactive and the supports operating in a passive mode of higher roll stiffness than the heave and pitch stiffness. In this passive mode the variable damper valves can be controlled for variable damping without any of the damper rams being driven in position.

When the mode switch is in the active or transfer mode, the deck attitude control system 250 is active and the controller is processing inputs from the sensors, including a bow sensor 283 which can sense load on the bow when in contact with a pylon, or additionally or alternatively can include an optical or relative proximity sensor able to detect the position of a reference point on the pylon relative to the bow of the vessel.

When the mode switch is in the normal or transit position there can still be some control of the attitude of the chassis portion, but preferably not both pitch and roll control of the chassis portion attitude. For example, the mode switch can include three positions: the active or transfer position described above where the deck attitude control system is operational; a roll adjusting or transit mode; and a passive position. For example, a roll displacer can be connected between the front left, front right, back left and back right support compression volumes. Alternatively, a roll displacer can be connected to the front left, front right, back left and back right actuator arrangements to allow the damper rams to be used impart a roll moment into the chassis portion. Other forms of fluid control than the roll displacer can also be used to roll the chassis portion into a turn. It can be beneficial during transit to control the roll attitude of the chassis portion to roll the vessel into turns, such as described in the Applicant's U.S. Pat. No. 10,286,980.

Modifications and variations as would be apparent to a skilled addressee are deemed to be within the scope of the present invention. For example, the damper rams can be electro-mechanical and be controlled to damp motions of the rams and therefore the vessel by extracting energy through inductance for example, and to similarly supply energy to drive the damper rams as required by the controller when the force and direction cannot be achieved by damping (extracting energy).

The invention claimed is:

1. A suspension system for a vessel, the vessel having at least one left hull, at least one right hull, and a chassis portion, the suspension system comprising:

locating arrangements for constraining motion of the at least one left hull and the at least one right hull in at least a longitudinal and a lateral direction relative to the chassis portion;

a plurality of supports for at least partially supporting the chassis portion relative to the at least one left hull and the at least one right hull, and at least one front left damper ram and connected between the chassis portion and longitudinally spaced points on the at least one left hull;

at least one back left damper ram connected between the chassis portion and longitudinally spaced points on the at least one left hull;

at least one front right damper ram connected between the chassis portion and longitudinally spaced points on the at least one right hull;

at least one back right damper ram connected between the chassis portion and longitudinally spaced points on the at least one right hull;

a deck attitude control system comprising a controller, at least one front left sensor, at least one back left sensor, at least one front right sensor, at least one back right sensor, each sensor comprising one of a force sensor, a pressure sensor, an acceleration sensor, an orientation sensor, and a position sensor, and a respective actuator arrangement for each of at least two longitudinal or lateral damper rams of the at least one front left damper ram, the at least one front right damper ram, the at least one back left damper ram, and the at least one back right damper ram, the controller configured to control the respective actuator arrangement for each of the at least two longitudinal or lateral damper rams of the at least one front left damper ram, the at least one front right damper ram, the at least one back left damper ram, and the at least one back right damper ram based upon signals from the at least one front left sensor, the at least one back left sensor, the at least one front right sensor, and the at least one back right sensor, and control at least one of an attitude of the chassis portion, and a position of at least one point on the chassis portion relative to at least one reference, each respective damper ram being controlled by the controller to provide a damping force based upon a limit damping force, wherein beyond the limit damping force, power is supplied to a respective damper ram by the respective actuator arrangement to provide a motive force.

2. The suspension system as in claim 1 wherein each sensor is configured to provide at least one respective output signal indicative of a force in the respective damper ram; and wherein a force in the respective damper ram is calculated based upon the at least one respective output signal.

3. The suspension system as in claim 1 wherein each sensor is configured to provide at least one respective output signal indicative of a displacement of the respective damper ram.

4. The suspension system as in claim 1 wherein the at least one reference comprises one of a point on an object, an absolute point in space, and an absolute orientation.

5. The suspension system as in claim 1 wherein each damper ram comprises an electro-mechanical ram.

6. The suspension system as in claim 1 wherein each respective actuator arrangement includes a respective motor.

7. The suspension system as in claim 1 wherein each respective actuator arrangement includes a respective motor comprising one of a linear motor, and an electro-magnetic actuator, the respective motor being at least in part adjacent the damper ram.

8. The suspension system as in claim 1 wherein each damper ram comprises a fluid ram including a respective compression chamber and a respective rebound chamber, the respective actuator arrangement configured to adjust pressures in the respective compression chamber and the respective rebound chamber of the at least two longitudinal or lateral damper rams.

9. The suspension system as in claim 8 wherein each actuator arrangement for the at least two longitudinal or lateral damper rams includes at least one respective valve.

10. The suspension system as in claim 8 wherein at least two of the respective actuator arrangements each includes a respective pump.

11. The suspension system as in claim 9 wherein the at least one respective valve includes:

a respective damper compression chamber control valve in fluid communication with a respective damper compression chamber; and a respective damper rebound chamber control valve in fluid communication with a respective damper rebound chamber.

12. The suspension system as in claim 11 wherein the respective damper compression chamber control valve is configured to adjust pressure in the respective damper compression chamber.

13. The suspension system as in claim 11 wherein the respective damper compression chamber control valve is configured to communicate the respective damper compression chamber with a pressure source.

14. The suspension system as in claim 13 wherein the respective damper compression chamber control valve is configured to communicate the respective damper compression chamber with a fluid reservoir.

15. The suspension system as in claim 13 wherein each damper ram includes a lower threshold pressure arrangement including non-return valves and a fluid pressure accumulator; wherein an upper threshold pressure in the fluid pressure accumulator is regulated by a pressure relief valve which relieves excess pressure; and wherein the respective damper compression chamber control valve is configured to communicate the respective damper compression chamber with the fluid pressure accumulator.

16. The suspension system as in claim 9 wherein the at least one respective valve includes a variable damper valve configured to provide a controllable variable restriction between at least the respective compression chamber and the respective rebound chamber.

17. The suspension system as in claim 16 wherein the variable damper valve is varied by the controller to provide a force in the damper ram that corresponds to a force required by the controller; and wherein beyond the limit damping force, the variable damper valve is restricted and a pressure in the respective compression chamber and the respective rebound chambers is controlled using a pump, a pressure source, and a reservoir.

18. The suspension system as in claim 1 wherein each of the plurality of supports varies in pressure by less than 25% through a range of at least 50% of a travel of each support.

19. The suspension system as in claim 1 wherein the plurality of supports is independent.

20. The suspension system as in claim 1 wherein the plurality of supports is at least partially interconnected.

21. The suspension system as in claim 1 wherein the plurality of supports is interconnected during a deck attitude control system operation.

22. The suspension system as in claim 1 wherein the plurality of supports includes a front left support ram, a front right support ram, a back left support ram, and a back right support ram; and wherein each respective support ram has at least a respective support compression chamber, the respective support compression chamber being at least part of a respective support compression volume.

23. The suspension system as in claim 22 wherein the front left support ram and the front right support ram are respectively interconnected by lateral cross connections; wherein each respective lateral cross-connection is between the respective support compression chamber of a front support ram on one side of the vessel and a support rebound chamber of a laterally spaced front support ram on an opposite side of the vessel; wherein the back left support ram and the back right support ram are respectively interconnected by lateral cross connections; and wherein each respective lateral cross-connection is between the respective support compression chamber of a back support ram on one side of the vessel and a back rebound chamber of a laterally spaced back support ram on an opposite side of the vessel.

* * * * *